United States Patent [19]

Watkins et al.

[11] 4,184,672

[45] Jan. 22, 1980

[54] CONTROL MEANS FOR THE SUPPLY OF OPERATING MEDIUMS AND SHEET FEEDING MACHINES HAVING THE SAME

[75] Inventors: Harry J. Watkins, Alresford; Christopher C. Storey, Westcliff-on-Sea, both of England

[73] Assignee: H.T.B. Limited, Essex, England

[21] Appl. No.: 839,202

[22] Filed: Oct. 4, 1977

[30] Foreign Application Priority Data

Oct. 5, 1976 [GB] United Kingdom ..... 41358/76

[51] Int. Cl.[2] ..... B65H 3/08

[52] U.S. Cl. ..... 271/105; 271/108

[58] Field of Search ..... 271/108, 98, 97, 105, 271/91–93

[56] References Cited

U.S. PATENT DOCUMENTS

| | | | |
|---|---|---|---|
| 3,294,396 | 12/1966 | Staines | 271/108 X |
| 3,419,263 | 12/1968 | Weidman | 271/108 |

*Primary Examiner*—Richard A. Schacher

*Attorney, Agent, or Firm*—Cushman, Darby & Cushman

[57] ABSTRACT

Control means for the supply of at least two operating mediums comprises a main valve for controlling the supply of one of the operating mediums and a subsidiary valve for controlling the supply of the or each other operating medium. The or each subsidiary valve is biased into its open or closed state and is adapted for connection to the main valve or the flow of the operating medium therefrom so that its state is reversed by the flow of that operating medium under the control of the main valve. The control means may be employed for controlling the supply of vacuum and compressed air to the lifting and/or forwarding suckers and one or more air blasts respectively of a sheet feeding machine.

8 Claims, 5 Drawing Figures

CONTROL MEANS FOR THE SUPPLY OF OPERATING MEDIUMS AND SHEET FEEDING MACHINES HAVING THE SAME

BACKGROUND OF THE INVENTION

1. Field of the Invention

This invention relates to control means for the supply of operating mediums and to sheet feeding machines having the same.

2. Prior Art

A machine for feeding sheets from a stack one at a time usually has two or more suckers for lifting one edge of the uppermost sheet and also means for creating a blast of air adjacent said edge of the uppermost sheet to assist its separation from the sheet underneath. In the case of a machine employing back edge separation it is normal to provide further suckers to which the sheet to be fed is transferred after its back edge has been lifted. The further suckers then move forwardly carrying the sheet with them before releasing the sheet to continue its forward movement. The forwarding suckers then return for the next sheet which, in the meantime, has been raised at its back edge by the lifting suckers. As in the case of the lifting suckers, the forward movement of each sheet effected by the forwarding suckers is assisted by a blast of air created beneath the sheet adjacent its raised back edge. The vacuum supply to each set of suckers and both the separating air blast and the forwarding air blast are controlled and timed by separate control means or by an expensive spool valve having a separate set of ports for each of the four different functions. Such machines are well known and capable of operating at speeds of, for example, 13000 sheets/hour.

A slower type of sheet feeding machine employs front edge separation. In this case the lifting suckers are mounted for pivotal movement about a horizontal axis so that they may act as both lifting suckers and forwarding suckers. The separating air blast is provided as before but the forwarding air blast may be omitted. The control means for the vacuum to the lifting and forwarding suckers and for the separating air blast are generally the same as described above in relation to a sheet feeding machine employing back edge separation. In each case the control means suffer from the disadvantage of separate valves whose timed sequence of operation is difficult to maintain and which, up to now, was generally overcome by providing an expensive combination spool valve.

SUMMARY

According to the invention control means for the supply of at least two operating mediums comprises a main valve for controlling the supply of one of the operating mediums and a subsidiary valve for controlling the supply of the or each other operating medium, the or each subsidiary valve being biased into its open or closed state and being adapted for connection to the main valve or the flow of said one operating medium therefrom so that its state is reversed by the flow of said one operating medium under the control of the main valve.

In one embodiment of the invention the or each subsidiary valve is connected to the flow of said one operating medium downstream of the main valve whereby operation of the main valve to allow said one operating medium to flow reverses the state of the or each subsidiary valve.

In another embodiment of the invention the or each subsidiary valve is connected to the main valve which allows the main valve to be operated to allow said one operating medium to flow in two stages, the first stage acting to reverse the state of the or each subsidiary valve and the second stage acting to perform its required function.

Preferably the main valve controls the flow of a vacuum and the or each secondary valve controls the flow of compressed air.

It is also preferred that the or each secondary valve is biased into its closed position, e.g. by a spring.

The invention also provides a sheet feeding machine having lifting and/or forwarding suckers for connection to a vacuum source, means for connection to a compressed air supply for creating a separating and/or forwarding air blast adjacent the edges of the uppermost sheets of a stack of sheets, and control means as described above for controlling the supply of said vacuum and compressed air.

The sheet feeding machine may be of the type employing back edge separation and comprise lifting suckers and separate forwarding suckers both of which are connectable to a vacuum source, means for creating a separating air blast adjacent the back edges of the uppermost sheets and means for creating a forwarding air blast beneath the raised back edge of the uppermost sheet both of which means are connectable to a compressed air supply, and control means as described above, which control means include a first main valve controlling the vacuum supply to the lifting suckers and having a connection to a secondary valve controlling the compressed air supply to the means for creating the separating air blast, and a second main valve controlling the vacuum supply to the forwarding suckers and having a connection to a further secondary valve controlng the compressed air supply to the means for creating the forwarding air blast, both secondary valves being biased into their respective closed positions.

Preferably the secondary valve controlling the separating air blast is connected to the first main valve in a manner whereby the secondary valve is opened prior to the lifting suckers becoming effective and preferably the further secondary valve controlling the forwarding air blast is connected to the flow of vacuum from the second main valve downstream of the second main valve.

DESCRIPTION OF THE PREFERRED EMBODIMENTS

Figure 1:
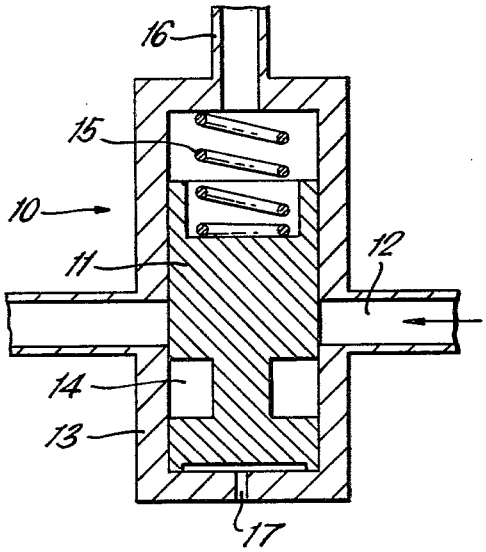
FIG. 1 is a cross-section, by way of example, through a valve in its closed state.
Figure 2:
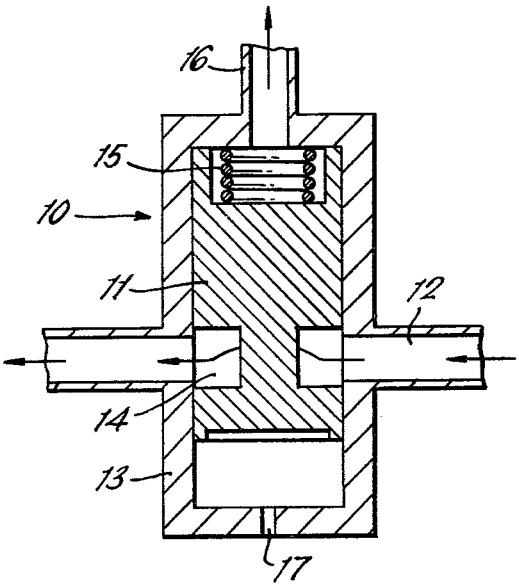
FIG. 2 is a cross-section through the valve of FIG. 1 in its open state.

Referring to FIGS. 1 and 2, a valve 10 has a plunger 11 spring biased into its closed state (FIG. 1) whereby it shuts off a passageway 12 for compressed air. The plunger 11 is slidable within a cylinder 13 and has an annular groove 14 which is aligned with the passageway 12 when the valve is in its open state, i.e. with the plunger 11 raised and the spring 15 compressed (FIG. 2). The state of the valve 10 is reversed by switching on or off another operating medium. In this embodiment, the upper end of the cylinder 13 has an outlet 16 for connection to a vacuum supply and the lower end has a vent hole 17. In operation switching on the vacuum will raise the plunger 11 against the spring pressure and thus open the valve 10. Switching off the vacuum will allow the spring 15 to depress the plunger and close the valve. In another embodiment, the outlet 16 may be provided in the base of the cylinder 13 and be connected to a pressure source. The vent hole 17 would then be provided in the upper end of the cylinder. As before, switching on the pressure source to the outlet 16 would open the valve and switching off the pressure source would allow the valve to close.

If desired, the other pressure source supplied to the outlet 16 may be used to close the valve 10 instead of opening the valve, for example by different location of the groove 14.

The invention is also not restricted to a valve for compressed air. It will thus be appreciated that the above described method of controlling the state of the valve may be applied to any valve which is intended to control the supply of one operating medium and which is itself controlled by another operating medium or from another source of the same operating medium.

Figure 3:
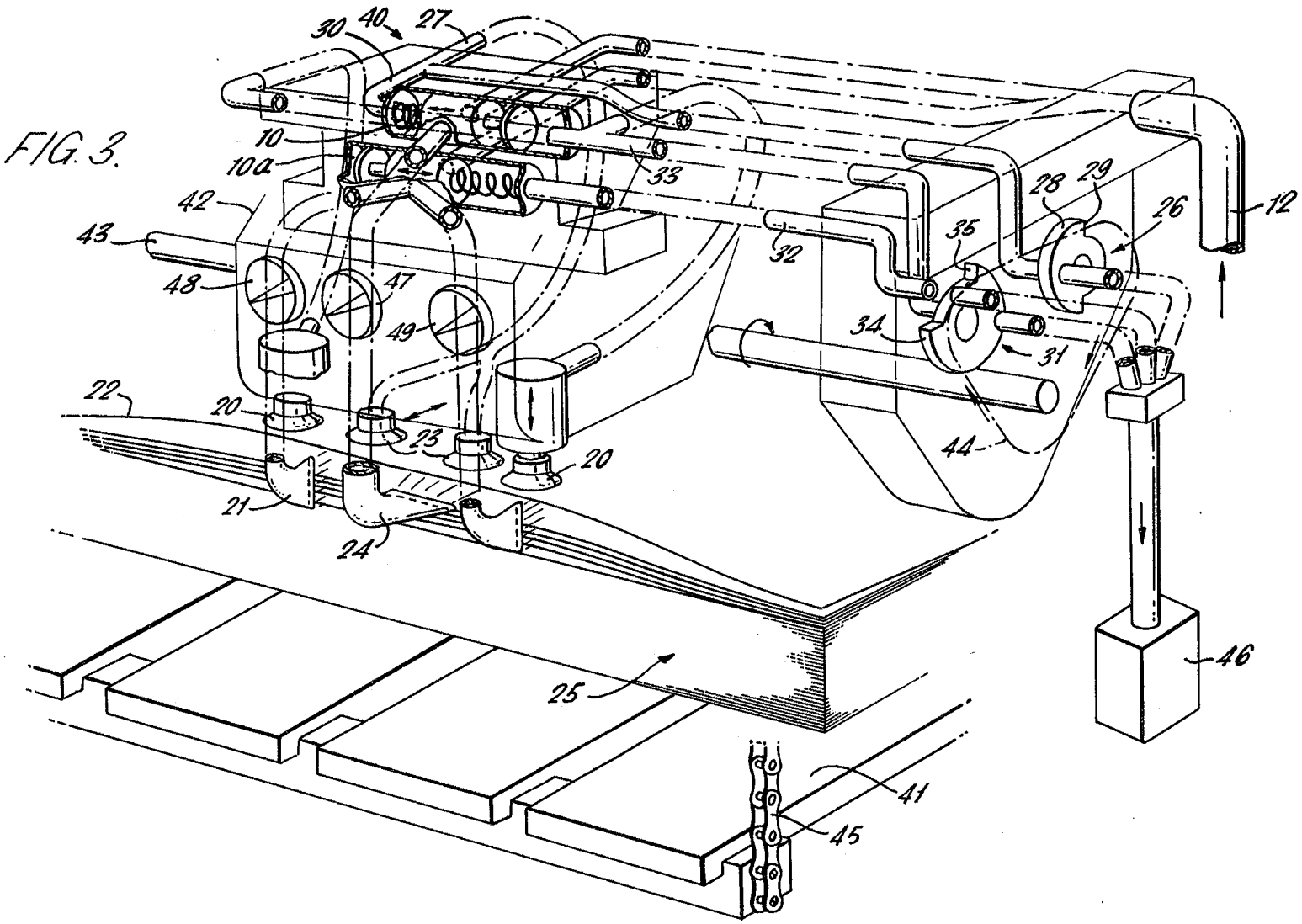
FIG. 3 shows a perspective representation, partly cut-away, of a sheet feeding machine having a separator head unit.
Figure 4:
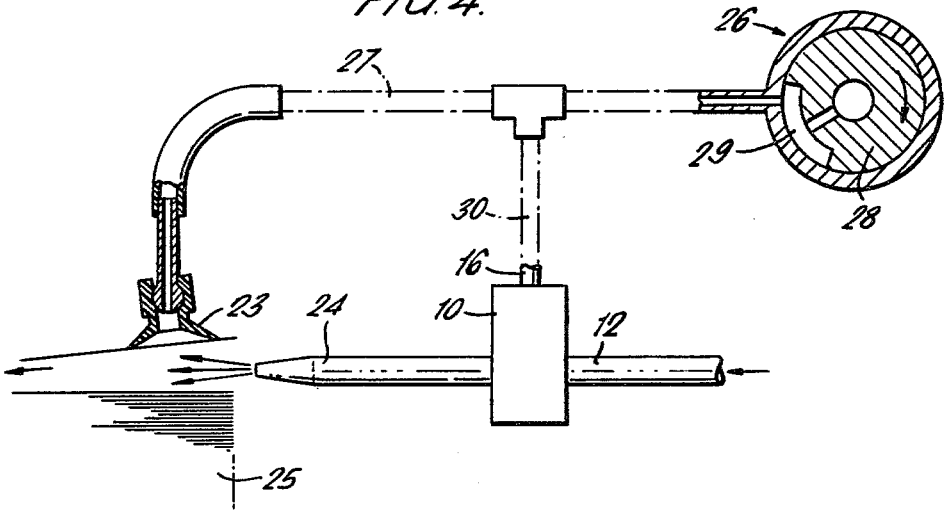
FIG. 4 shows diagrammatically the part of the separator head unit of the sheet feeding machine of FIG. 3 which incorporates a valve as shown in FIG. 1 so that the vacuum supply to the forwarding suckers controls the forwarding air blast.
Figure 5:
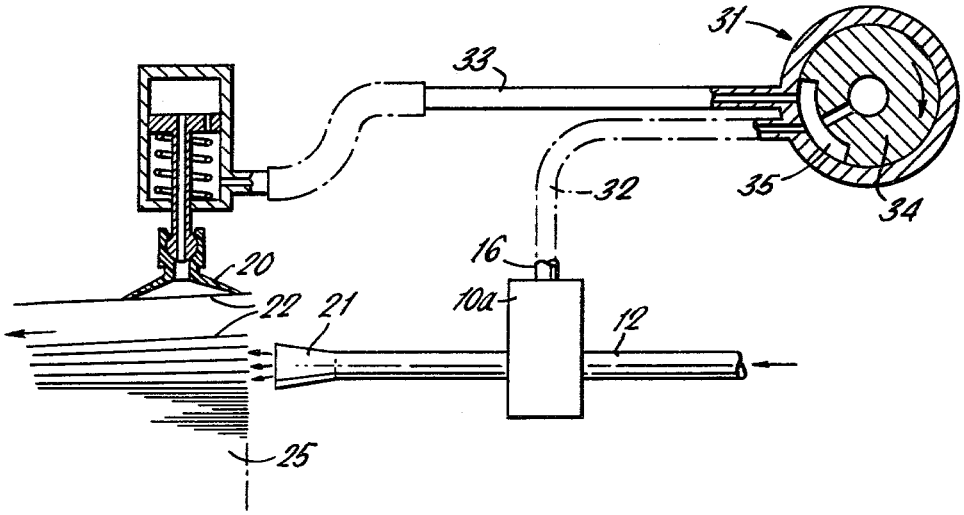
FIG. 5 shows diagrammatically the part of the separator head unit of the sheet feeding machine of FIG. 3 which incorporates another valve as shown in FIG. 1 so that the vacuum supply to the lifting suckers controls the separating air blast.

A particular use for the valve of FIGS. 1 and 2 is in the control of an air blast which is required in a sheet feeding machine. With reference to FIGS. 3 to 5, there is shown a sheet feeding machine 40 of the type employing back edge separation. The machine 40 has a vertically movable table 41 which is moved upwardly by chains 45 in a conventional manner, as sheets 22 are removed one by one from a stack 25 of sheets on the table. Above the stack 25 is mounted a separator head unit 42, or if necessary a pair of separator head units, the or each head unit supporting a pair of lifting suckers 20 and means 21 for creating an associated air blast for separating the back edges of the uppermost sheets 22 of the stack 25 of sheets (FIGS. 3 and 5), and a pair of forwarding suckers 23 and means 24 for creating an associated air blast for assisting the forward movement of each sheet (FIGS. 3 and 4). The construction of each sucker 20, 23 and the air blast means 21, 24 are conventional, and the suckers are mounted on the separator head unit 42 for their necessary reciprocating movements under the control of the suckers and for effecting mechanical drive means within the head unit. The drive means are driven by a spindle 43 connected in driving relation with a chain drive 44 driven in synchronisation with the main drive of the sheet feeding machine.

This invention is concerned with the manner of controlling each air blast by using the vacuum supply to the associated suckers. Referring first to the forwarding air blast shown in detail in FIG. 4, the supply of air is controlled by a first subsidiary valve 10 of the type described above with reference to FIGS. 1 and 2 mounted in the air supply means 24, and the vacuum supply to the forwarding suckers 23 is controlled by a rotary main valve 26 having an inlet connected to a vacuum pump 46 and an outlet connected to the suckers 23 by a conduit 27. One revolution of the rotor 28 of the valve 26, which rotor 28 is driven by the chain drive 44, is equivalent to one cycle of operation of the sheet feeding machine, and the rotor has a circumferential port 29 which determines the operative period of the forwarding suckers 23 during each cycle. The outlet 16 of the valve 10 is connected by a conduit 30 to the conduit 27, whereby the valve 10 will be opened once the supply of vacuum to the forwarding suckers 23 has caused the forwarding suckers 23 to seal onto the top sheet of the stack 25. The timing of the air blast for each cycle of operation of the sheet feeding machine is thus substantially synchronised with the effective period of operation of the forwarding suckers. The rate of flow of air through the conduit 27, and therefore the force of the forwarding air blast, is adjustable by means of a control knob 47.

Operation of the lifting suckers of the sheet feeding machine and the separating air blast may be controlled in the same manner as described above in connection with the forwarding suckers and the forwarding air blast. However, in practice, it is desirable that the period of operation of the separating blast is at least initiated prior to the effective period of operation of the lifting suckers, and control means for achieving this are shown in FIGS. 3 and 5. The arrangement again employs a rotary main valve 3, connected to the vacuum pump 46 for controlling the vacuum supply to the lifting suckers 21, and a second subsidiary valve **10*a*, identical to the above-mentioned valve 10, for controlling the timing of the separating air blast. The difference is that the outlet 16 of the valve 10*a* is connected by a conduit 32 to the rotary valve 31 direct instead of to the conduit 33 connecting the lifting suckers 20 to the rotary valve 31, the connection of the conduit 32 to the rotary valve 31 being in advance of the connection of the conduit 33 to the rotary valve. Accordingly during rotation of the rotor 34 of the valve 31, which rotor 34 is also driven by the chain drive 44, the port 35 of the rotor 34 will first become open to the conduit 32 and thus switch on the separating air blast and subsequently become open to the conduit 33 to supply vacuum to the lifting suckers 20, the separating air blast being maintained until the lifting suckers have sealed onto and raised the uppermost sheet of the stack 25. Such an arrangement would not be desirable for the forwarding suckers of FIG. 4 because the forwarding air blast is not required until the forwarding suckers have firmly gripped the sheet to be moved. Therefore the more simple arrangement of FIG. 4 is both adequate and fail safe. The force of the separating air blast is also adjustable by means of control knobs 48,49**.

If desired the rotary valves 26,31 may be two separate valves, as in this embodiment, or the same result may be achieved by providing a single rotary valve having a rotor with axially spaced ports 29,35.

The main advantages of the control means of the sheet feeding machine describes above compared with conventional control means are that they simplify the timing of the air and vacuum functions, eliminate flow restrictions and improve the air blast characteristics whilst using low cost components.

The invention is not restricted to the specific details of the sheet feeding machine described above. For example, instead of the vacuum source for each pair of suckers being used to open the respective valve 10, 10*a* to permit an associated air blast, each compressed air source may be used to open a valve permitting a vacuum source to pass to the associated suckers. Accordingly the valve controlling the supply of compressed air to the forwarding air blast would be the main valve and would control the supply of vacuum to the forwarding suckers, and the valve controlling the supply of compressed air to the separating air blast would be a second main valve which would control the supply of vacuum to the lifting suckers.

The sheet feeding machine may also have more than two lifting suckers and/or more than two forwarding suckers.

Furthermore, the invention may also be applied to a sheet feeding machine in which the same set of suckers act as both lifting and forwarding suckers in which case the vacuum supply thereto would control both the separating air blast and the forwarding air blast, or a machine of the type employing forward edge separation in which there are also only one set of suckers and the forwarding air blast may not be required.

The invention may further be applied to any other form of sheet feeding machine. For example, the invention may be applied to a machine for feeding corrugated sheets in which case the separating air blast may be omitted. Alternatively, the invention may be applied to a machine having lifting suckers and a separating air blast, the separated sheets being fed forwardly by means other than the same or more suckers, for example by a forwarding air blast alone.

With reference to the above description of a sheet feeding machine, both FIGS. 4 and 5 show a supply of vacuum controlling a single subsidiary valve for the supply of compressed air. It will be appreciated that the invention is also applicable to the employment of the vacuum to control two or more subsidiary valves for the supply of the same or different operating mediums. Indeed the operating medium or one of the operating mediums being controlled may be vacuum from another vacuum source.

We claim:

1. A sheet feeding machine having pneumatic sheet-handling suckers connectable to a vacuum source, means connectable to a compressed air supply for creating air blasts adjacent the edges of the uppermost sheets of a stack of sheets in order to act on the sheets, and means for controlling the vacuum and compressed air operating mediums whereby each operating medium may perform its respective primary function and one of the operating mediums may perform an additional secondary function, the control means comprising at least one main valve for controlling said one operating medium, which main valve has a first connection to a point downstream of the main valve at which said one operating medium performs its primary function and at least one second connection leading from the main valve to a respective subsidiary valve for controlling the other operating medium, which subsidiary valve is biased into one of its open and closed states and whose state is reversed by the flow of said one operating medium through the main valve and the respective second connection, said one operating medium thereby performing its secondary function.

2. A sheet feeding machine as claimed in claim 1, wherein the second connection leading to the respective subsidiary valve leads off the first connection of the respective main valve whereby operation of the main valve to allow said one operating medium to flow reverses the state of the subsidiary valve.

3. A sheet feeding machine as claimed in claim 1, wherein the second connection leading to the respective subsidiary valve leads directly from the respective main valve which allows the main valve to be operated to allow said one operating medium to flow in two stages, the first stage acting to reverse the state of the subsidiary valve and the second stage acting to perform its primary function.

4. A sheet feeding machine as claimed in claim 1, wherein the main valve controls the flow of vacuum supplied to the suckers and the secondary valve controls the flow of compressed air supplied to the means for creating separating and/or forwarding blasts.

5. A sheet feeding machine as claimed in claim 1, wherein the subsidiary valve is biased into its closed state.

6. A sheet feeding machine as claimed in claim 1, wherein the machine is of the type employing back edge separation, which machine comprises both lifting suckers and separate forwarding suckers, and both means for creating a separating air blast adjacent the back edges of the uppermost sheets and means for creating a forwarding air blast beneath the raised back edge of the uppermost sheet, the control means comprising a first main valve having a first connection supplying vacuum to the lifting suckers and a second connection for supplying vacuum to a subsidiary valve controlling the compressed air supply to the means for creating the separating air blast, and a second main valve having a first connection for supplying vacuum to the forwarding suckers and a second connection for supplying vacuum to a further subsidiary valve controlling the compressed air supply to the means for creating the forwarding air blast, both subsidiary valves being biased into their respective closed positions.

7. A sheet feeding machine as claimed in claim 6, wherein the subsidiary valve controlling the separating air blast is connected to the first main valve by the respective second connection in a manner whereby the subsidiary valve is opened prior to the lifting suckers becoming effective.

8. A sheet feeding machine as claimed in claim 6, wherein the further subsidiary valve controlling the forward air blast is connected to the second main valve by the respective second connection leading from the respective first connection connecting the second main valve to the forwarding suckers.

* * * * *